US007372968B2

(12) United States Patent
Buos et al.

(10) Patent No.: US 7,372,968 B2
(45) Date of Patent: May 13, 2008

(54) LOUDSPEAKER DRIVER

(75) Inventors: Andreas Buos, Cambridgeshire (GB); Martin Colloms, London (GB)

(73) Assignee: New Transducers Limited, London (GB)

( * ) Notice: Subject to any disclaimer, the term of this patent is extended or adjusted under 35 U.S.C. 154(b) by 1071 days.

(21) Appl. No.: 09/986,115

(22) Filed: Nov. 7, 2001

(65) Prior Publication Data

US 2002/0054690 A1 May 9, 2002

Related U.S. Application Data

(60) Provisional application No. 60/247,967, filed on Nov. 14, 2000.

(30) Foreign Application Priority Data

Nov. 8, 2000 (GB) ..... 0027278.1

(51) Int. Cl.
*H04R 25/00* (2006.01)

(52) U.S. Cl. ..... 381/152; 381/396; 381/431

(58) Field of Classification Search ..... 381/152, 381/431, 395–396, 398, 403, 404, 405, 412, 381/420, 386, 387, 389; 340/388.1, 311.1, 340/7.6, 384.1, 407, 407.1
See application file for complete search history.

(56) References Cited

U.S. PATENT DOCUMENTS 1,985,722 A * 12/1934 Erickson ..... 381/398
2,698,917 A * 1/1955 Van Urk et al. ..... 335/302
3,430,007 A * 2/1969 Thielen ..... 381/152
4,387,275 A 6/1983 Shimada et al.
4,495,638 A * 1/1985 Yamada et al. ..... 381/27
4,506,117 A * 3/1985 Fresard ..... 381/162
4,514,599 A * 4/1985 Yanagishima et al. ..... 381/152
4,926,486 A * 5/1990 Barsumian ..... 381/152
4,967,871 A * 11/1990 Komatsubara ..... 181/141
5,321,763 A 6/1994 Lee
5,956,622 A * 9/1999 Lee ..... 340/7.6
6,404,085 B2 * 6/2002 Hamaguchi et al. ..... 310/81
6,516,071 B1 * 2/2003 Liu ..... 381/152

(Continued)

FOREIGN PATENT DOCUMENTS

GB 2 027 316 A 2/1980

(Continued)

*Primary Examiner*—Curtis Kuntz
*Assistant Examiner*—Phylesha L Dabney
(74) *Attorney, Agent, or Firm*—Foley & Lardner LLP

(57) ABSTRACT

An inertial exciter (40) for an acoustic radiator (42), and a loudspeaker incorporating an acoustic radiator and such an exciter. The exciter has a massive member (44); a coupler (56) adapted for attachment to the acoustic radiator (42) and adapted for relative movement with respect to the massive member (44); a motor for effecting relative movement of the coupler with respect to the massive member; and a suspension (60) for supporting the massive member relative to the coupler. The suspension (60) acts in a plane generally passing through the center of mass of the massive member, thereby reducing any moment acting on the suspension.

Also disclosed is a loudspeaker exciter assembly (70) that has a base plate (86) for attachment to an acoustic radiator in a non-repeatedly engageable manner, and an exciter (40) attached to the base plate (86) in a repeatedly engageable manner; and a loudspeaker incorporating such an exciter assembly.

33 Claims, 3 Drawing Sheets

U.S. PATENT DOCUMENTS

| | | | | |
|---|---|---|---|---|
| 6,529,611 | B2 * | 3/2003 | Kobayashi et al. | 381/396 |
| 6,618,487 | B1 * | 9/2003 | Azima | 381/152 |
| 6,622,817 | B1 * | 9/2003 | Bachmann et al. | 181/150 |
| 2003/0146825 | A1 * | 8/2003 | Kaneda et al. | 340/388.1 |

FOREIGN PATENT DOCUMENTS

| | | | |
|---|---|---|---|
| JP | 49-45294 | | 12/1974 |
| JP | 58-172287 | | 11/1983 |
| JP | 58-218296 | | 12/1983 |
| JP | 60-77179 | | 5/1985 |
| JP | 61013900 | | 1/1986 |
| JP | 63-68297 | | 5/1988 |
| JP | 1-142294 | | 9/1989 |
| JP | 2001016686 | | 1/2001 |
| WO | WO 97/09842 | | 3/1997 |
| WO | WO 98/34320 | | 8/1998 |
| WO | WO 98/52381 | | 11/1998 |
| WO | WO 99/60819 | A1 | 11/1999 |
| WO | WO 00/47013 | | 8/2000 |

* cited by examiner

LOUDSPEAKER DRIVER

This application claims the benefit of provisional application No. 60/247,967, filed Nov. 14, 2000.

FIELD OF THE INVENTION

This invention relates to drivers or exciters for loudspeakers, in particular but not exclusively for the class of loudspeakers known as bending wave panel-form loudspeakers.

BACKGROUND ART

Such loudspeakers are known, for example, from international application WO97/09842, and counterpart U.S. application Ser. No. 08/707,012, filed Sep. 3, 1996, both to New Transducers Ltd. In general, such speakers include a resonant bending wave acoustic radiator, e.g. in the form of a plate, and a transducer mounted on the plate to convert electrical signals into mechanical vibrations. The transducer excites the resonant bending wave modes in the plate, which then emits sound to create an acoustic output.

The properties of the acoustic radiator may be chosen to distribute the resonant bending wave modes substantially evenly in frequency. In other words, the properties or parameters, e.g. size, thickness, shape, material, etc., of the acoustic radiator may be chosen to smooth peaks in the frequency response caused by "bunching" or clustering of the modes. The resultant distribution of resonant bending wave modes may thus be such that there are substantially minimal clusterings and disparities of spacing.

In particular, the properties of the acoustic radiator may be chosen to distribute the lower frequency resonant bending wave modes substantially evenly in frequency. The number of resonant bending wave modes is less at lower frequencies than at higher frequencies and thus the distribution of the lower frequency resonant bending wave modes is particularly important. The lower frequency resonant bending wave modes are preferably the ten to twenty lowest frequency resonant bending wave modes of the acoustic radiator. The resonant bending wave modes associated with each conceptual axis of the acoustic radiator may be arranged to be interleaved in frequency. Each conceptual axis has an associated lowest fundamental frequency (conceptual frequency) and higher modes at spaced frequencies. By interleaving the modes associated with each axis, the substantially even distribution may be achieved. There may be two conceptual axes and the axes may be symmetry axes. For example, for a rectangular acoustic radiator, the axes may be a short and a long axis parallel to a short and a long side of the acoustic radiator respectively. For an elliptical acoustic radiator, the axes may correspond to the major and minor axis of the ellipse. The axes may be orthogonal.

The transducer location may be chosen to couple substantially evenly to the resonant bending wave modes. In particular, the transducer location may be chosen to couple substantially evenly to lower frequency resonant bending wave modes. In other words, the transducer may be mounted at a location spaced away from nodes (or dead spots) of as many lower frequency resonant modes as possible. Thus the transducer may be at a location where the number of vibrationally active resonance anti-nodes is relatively high and conversely the number of resonance nodes is relatively low. Any such location may be used, but the most convenient locations (for a rectangular panel) are the near-central locations between 38% to 62% along each of the length and width axes of the panel, but off-central. Specific locations found suitable are at 3/7, 4/9 or 5/13 of the distance along the axes; a different ratio for the length axis and the width axis is preferred.

A particularly preferred kind of exciter for use with bending wave loudspeakers is the inertial exciter, an example of which is shown attached to a panel form member 15 in FIG. 1. The exciter 14 comprises an electromagnetic motor made up of a magnet assembly and a voice coil assembly. The magnet assembly comprises a magnet 20, a pole piece 22 and a magnet cup 24 such that the magnet 20 is sandwiched between and attached to both the pole piece 22 and the magnet cup 24.

The voice coil assembly comprises a voice coil 26 wound on a former 27 which is attached to a coupler ring 28 which in turn is mounted on a mounting surface 30 of the panel-form member 15. The magnet assembly 20,22,24 is mounted on the voice coil assembly by means of a suspension 32 attached between the voice coil former 27 and the magnet cup 24.

Through audio connections (leads) 34, the exciter 14 receives electrical signals which are fed to voice coil 26. In accordance with well-known electromagnetic principles, these signals result in a force being exerted on the magnet assembly, with a reaction force being exerted on the voice coil, coupler ring and finally the panel 15. As a result of the higher mass (inertia) of the magnet assembly, it is the panel 15 that moves and, in combination with the preferential positioning mentioned above, generates sound.

The present inventors have identified two problems with known methods of mounting the magnet assembly. Firstly, when installed on a non-horizontal panel as shown in FIG. 1, the exciter tends to "creep", i.e. twist on its suspension under the effect of the weight, W, of the magnet assembly acting through its centre of mass, M. Secondly, the exciter may exhibit rocking modes which degrade power handling, shorten life, and increase distortion. In particular, leakage of energy into rocking modes may impair the power delivery at the lowest frequencies.

Further issues surround the mounting of the exciter as a whole. As is known, it may be advantageous to attach an exciter to a bending wave, panel-form loudspeaker by means of adhesive. However, should an exciter attached in this manner develop a fault, it will be necessary to break the adhesive joint and remove adhesive residue from the surface of the loudspeaker panel before a replacement exciter can be attached by means of a new adhesive bond.

SUMMARY OF THE INVENTION

It is an object of the invention to ameliorate the aforementioned problems and provide an improved exciter for use in such loudspeaker applications.

According to a first aspect of the invention there is provided an inertial exciter for an acoustic radiator, the exciter comprising:

a massive member;

a coupler adapted for attachment to the acoustic radiator and adapted for relative movement with respect to the massive member;

a motor for effecting relative movement of the coupler and the massive member; and a suspension for supporting the massive member relative to the coupler;

wherein the suspension acts in a plane generally passing through the centre of mass of the massive member, thereby reducing any moment acting on the suspension.

As a result of this latter feature, the exciter may have dynamic balance, and suspension drift or creep under the force of gravity for a vertical placement may be alleviated.

In a preferred embodiment, the motor is electromagnetic and has a voice coil assembly and a magnet assembly, the coupler mounts the voice coil assembly on an acoustic radiator, and the massive member comprises the magnet assembly.

It should be noted that in the context of this patent application, the term "massive member" generally means a member having a mass greater than the combined masses of the other components of the exciter.

A second aspect of the present invention concerns a loudspeaker exciter assembly comprising:

a base plate for attachment to an acoustic radiator in a non-repeatedly engageable manner; and an exciter attached to said base plate in a repeatedly engageable manner.

Such an arrangement provides the vibration transfer benefits of a non-repeatedly engageable connection—such as adhesive—to the loudspeaker panel together with ease of replaceability of the exciter unit associated with a repeatedly-engageable, releasable connection, such as a screw thread.

Also included in the invention are loudspeakers incorporating one or both of the aforementioned aspects.

Further advantageous embodiments of the invention are set out in the description and the appended claims.

BRIEF DESCRIPTION OF THE DRAWING

Examples that embody the best mode for carrying out the invention are described in detail below and are diagrammatically illustrated in the accompanying drawing, in which.

DETAILED DESCRIPTION

Figure 1:
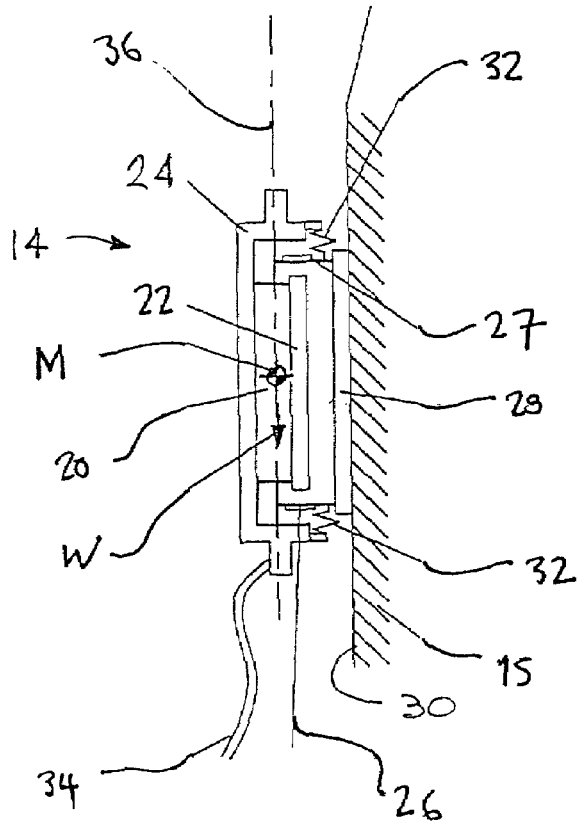
Fig 1 (PRIOR ART)
FIG. 1 is a cross-sectional view of a known prior art exciter.

FIG. 1 shows a known prior art exciter 14 and is described in detail above. As is shown in FIG. 1, the suspension 32 is spaced away from the plane of centre of mass 36 of the magnet assembly 20,22,24.

Figure 2:
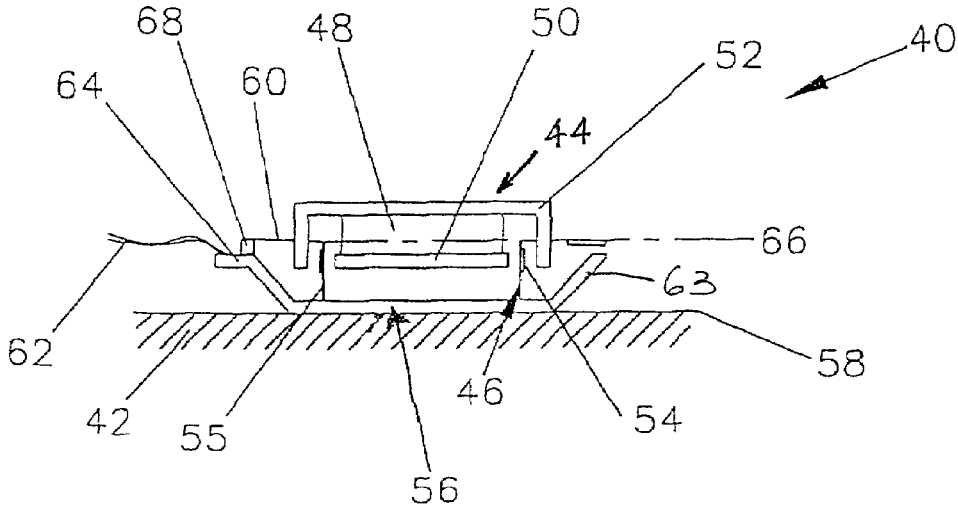
FIG. 2 is a cross-sectional view of an exciter according to a first embodiment of the invention.
Figure 3:
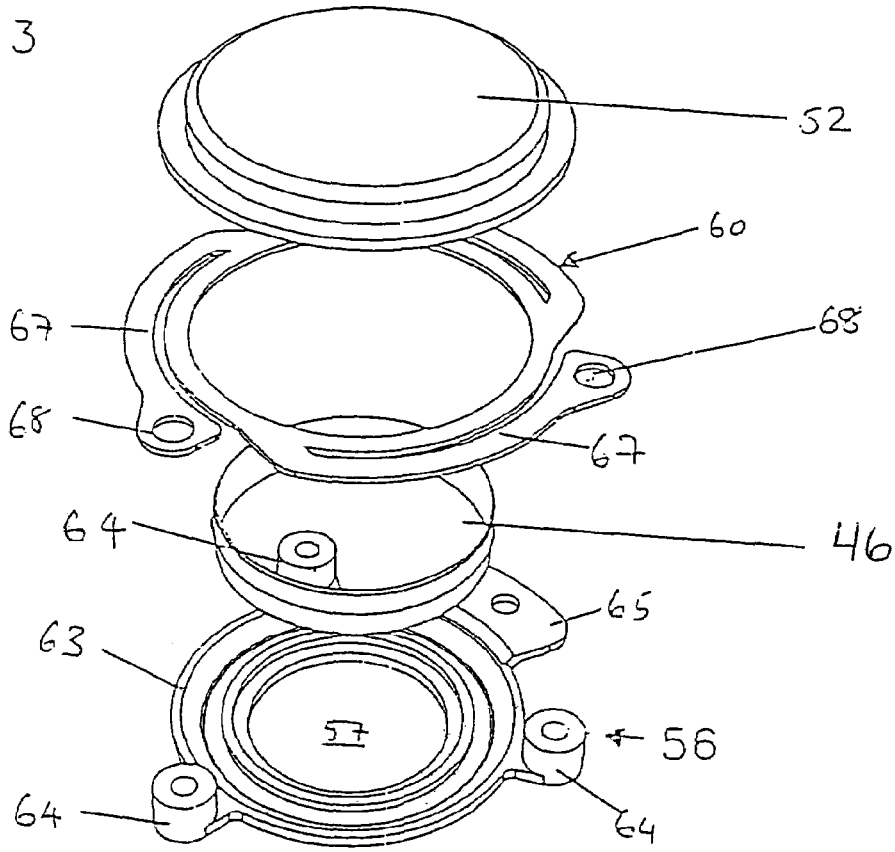
FIG. 3 is an exploded view of the exciter of FIG. 2.

FIGS. 2 and 3 show an exciter 40 according to the present invention. In FIG. 2, the exciter 40 is mounted on an acoustic radiator 42 and comprises an electromagnetic motor made up of a magnet assembly 44 and a voice coil assembly 46. The magnet assembly 44 comprises a magnet 48, a pole piece 50 and a magnet cup 52 such that the magnet 48 is sandwiched between and attached to both the pole piece 50 and the magnet cup 52. The voice coil assembly 46 comprises a voice coil 54 wound on a former 55 which is attached to a coupler 56.

The voice coil assembly 46 of the exciter 40 is attached to the acoustic radiator 42 via the coupler 56 mounted on a mounting surface 58 of the acoustic radiator 42. The magnet assembly 44 is mounted adjacent the voice coil assembly 46 by means of a suspension spider 60 attached between the coupler 56 and the magnet cup 52.

As shown in FIG. 3, the coupler 56 is in the form of a shallow cup and is made of plastics. The coupler 56 has a generally disc-like base 57 which provides a large bonding area for mounting on the acoustic radiator 42, and a side wall 63 running around the circumference of and at an angle of approximately 45° to the plane of the base. Three individual mounting provisions 64 project from the top of the side wall 63 and are equally spaced around the circumference of the base. The mounting provisions 64 are generally cylindrical. A fourth projection 65 which is generally flat with a larger surface area than that of the cylindrical mounting provisions 64 also projects from the side wall 63 and may be used to support the connections (leads) 62 (see FIG. 2).

The suspension spider 60 is a planar member in the form of a ring having three arms 67 and may be considered to be in the form of a metal cantilever suspension. The ring of the suspension spider 60 is fixed to the outside of the magnet cup 52 whilst one end of each arm 67 carries a suspension point 68, each of which coincide with one of the three individual mounting provisions 64 on the coupler 56. The coupler 56 may be fixed to the metal cantilever suspension (60) by soldering tags (not shown).

As shown in FIG. 2, and in contrast to the prior art exciter 14 of FIG. 1, the suspension points 68 are in the plane of the centre of mass 66 of the massive member of the exciter, in this case the magnet assembly 48,50,52. Thus the exciter is balanced and the problems of "creep" of the suspension under the force of gravity when the exciter is mounted in non-horizontal orientation should be alleviated. It will also be appreciated that such balance will help reduce unwanted rocking modes of the massive magnet assembly relative to the voice coil.

Furthermore, such an arrangement provides much stiffer lateral support in vertical mounting positions of the exciter (e.g., desk top multimedia, picture speaker applications, etc.) as well as in horizontal mounting positions (e.g., ceiling speakers, etc.). Thus, linear distortions caused by unstable support of the voice coil position in the air gap of the magnetic circuit may be prevented. In addition, stable support of the magnet assembly relative to the voice coil allows gap tolerances to be tightened, thereby providing greater sensitivity and available force.

Advantageously, the suspension support point (the ring of suspension spider 60) is located towards the periphery of the exciter and at a greater radial position than for conventional constructions. The resulting additional support may provide improved restoring forces to control residual unwanted asymmetric movement. In particular, the stability of linear magnet movement is enhanced and a linear imparting of a mechanical force [N] at the drive point of a panel is provided.

In the particular embodiment shown, the exciter 40 is attractively lightweight, slim and robust, having a 25 mm diameter, 4 ohm impedance and a short voice coil 54 which receives signals through audio connections 62 mounted on one of the mounting provisions 64.

It will be appreciated that the first aspect of the invention is not restricted to the embodiment detailed above. For example, the suspension may be a spider formed from a corrugated foil of metal or polymer or a strengthened cloth. Alternatively, the suspension may be in the form of an arm type cantilever which may be made from polymer or thin metal, e.g. stainless steel or beryllium copper. The suspension may be made from low corrosion metal alloys for high-stress environments. Such metal alloys are generally resistant to adverse effects of humidity and temperature, are low fatigue and have good long-term stability. The cantilever suspension may also be formed by thermoforming pressing or moulding, for example, for a foil or thin plate suspension. The suspension may be attached to the coupler, for example by a screw and stud construction or alternatively by use of adhesive to reduce mass. Alternatively, the suspension may be co-moulded or moulded integrally with the coupler.

It will also be appreciated that by attaching the exciter to the suspension in the plane of the centre of mass of the magnet assembly, a portion of the mass of the suspension may add to the mass of the exciter at a driving point on the acoustic radiator. Accordingly, the design of the exciter should take into account the additional mass.

As regards the magnet assembly comprising a magnet sandwiched between a magnet cup and a pole piece, the cup defining a magnet gap around the magnet, the magnet gap may be filled with retentive fluid of suitable viscosity to damp motion of the voice coil. Such fluid may also provide thermal dissipation.

Finally, it should be understood that whilst the massive member of the first aspect is most likely to be the magnet assembly of an electromagnetic motor system, the invention does include non-electromagnetic arrangements and electromagnetic arrangements in which a voice coil or its equivalent fulfill the role of the massive member.

Figure 4A:
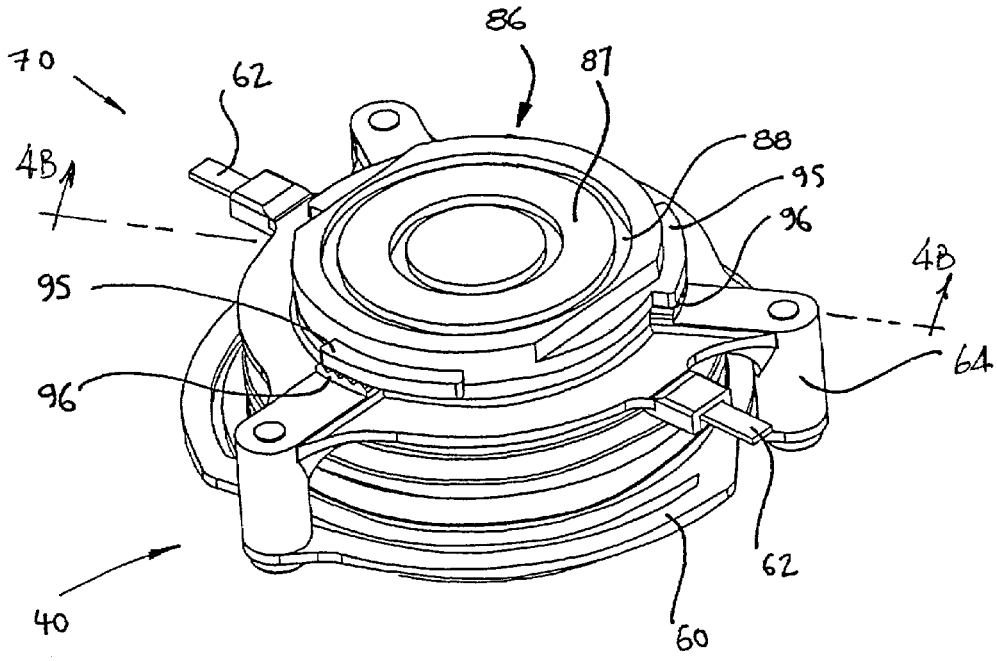
FIG. 4A is a perspective view of an exciter according to a second embodiment of the invention.
Figure 4B:
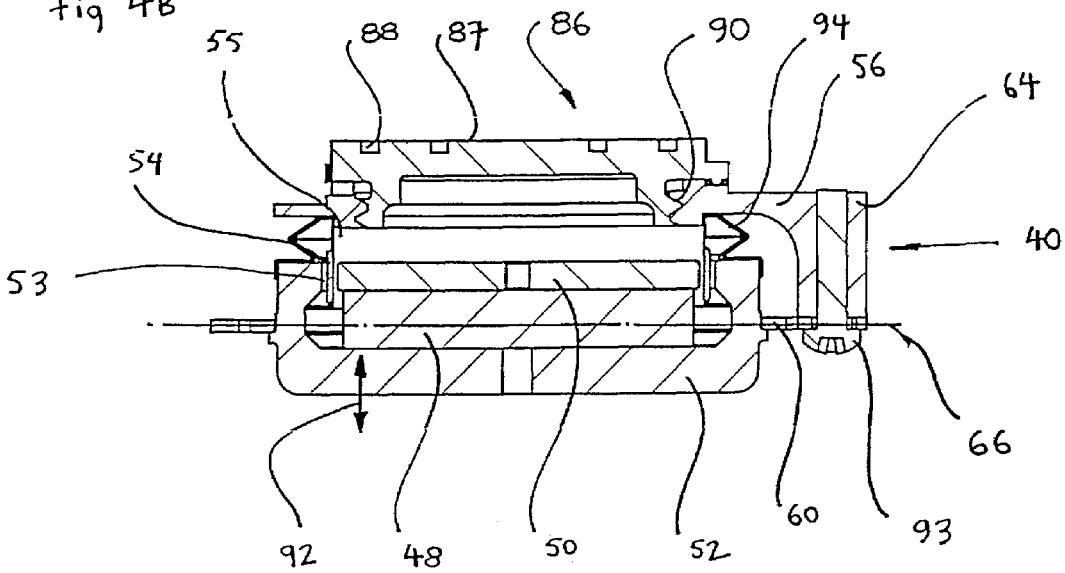
FIG. 4B is a cross-sectional view taken along line 4B-4B in FIG. 4A.

FIGS. 4A and 4B are perspective and sectional views, respectively, of a loudspeaker exciter assembly 70 incorporating an exciter 40 similar to that of FIG. 2, but having reduced thickness. The same reference figures have been used for those features common to the two exciters. However, the orientation of the illustration has been reversed so as to better show the second aspect of the invention, namely a base plate 86 for attachment in a non-repeatable manner to the surface of a loudspeaker panel (not shown). To this end, the surface 87 of the plate is formed with annular grooves 88 to accommodate adhesive.

Base plate 86 is in turn provided with a screw connection 90 which allows releasable—and thus repeatable—engagement of an exciter 40. As in the previous embodiment, this comprises a magnet assembly made up of magnet 48, pole piece 50 and magnet cup 52. This assembly is suspended for movement (denoted by arrow 92) relative to coupler 56 by a suspension spider 60. In the example shown, the inner periphery of spider 60 is mounted on magnet cup 52 such that it acts in a plane 66 generally passing through the centre of mass of the magnet assembly, in accordance with the first aspect of the invention.

The outer periphery of spider 60 is attached, e.g. by means of screws 93, to mounting provisions 64 of the coupler 56. As in the earlier embodiment, coupler 56 also carries a former 55 on which is wound a voice coil 54. This sits in an annular gap 94 formed by the extremities of the pole piece 50 and cup 52 and, as is well known, excites the magnet assembly to movement when supplied with an electrical drive signal via connections 62. A bellows seal 94 protects coil and gap from dirt, moisture and the like without inhibiting this movement.

The security of the releasable screw thread connection between coupler 56 and base plate 86 is ensured in the embodiment shown by pawls 95 formed on base plate 86 and which engage with corresponding racks 96 formed on the coupler 56. In a manner generally known per se, the teeth of the pawls and racks are so angled as to allow the screw connection to be tightened but to prevent it from being released without intervention to disengage the pawl and rack. Such intervention, e.g. by means of a screwdriver, allows the exciter 40 to be detached and a replacement unit to be installed quickly, easily and independently of the adhesive bond between the panel and base plate 86.

Although described above in combination with an exciter according to the first aspect of the invention, it will be appreciated that this second aspect can be implemented independently of the exciter design. It will also be understood that alternative designs, e.g. of the screw connection and pawl locking arrangements, can be used. Similarly, alternatives to adhesive for non-repeatably attaching the base plate to the acoustically-radiating loudspeaker panel can be used or indeed the base plate can be formed integrally with the panel.

Figure 5:
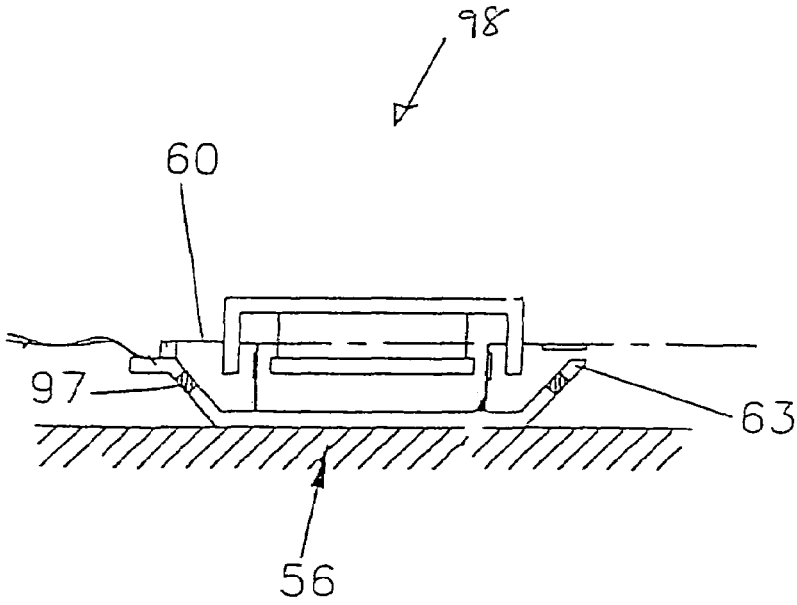
FIG. 5 is a cross-sectional view of an exciter according to a third embodiment of the invention.

FIG. 5 shows an exciter 98 similar to the exciter 40 of FIG. 2 but having an annular compliant member 97 incorporated into the side wall 63 of the coupler 56. The compliant member 97 has a lower compliance than the compliance of the suspension spider 60 and is connected in mechanical series between a region of the coupler local to the voice coil and regions of the coupler to which the suspension is attached or electrical lead out connections are located. By adding the compliant member, a lower effective mass at the driving point may be achieved with respect to the electrical lead out connections and the suspension.

The compliant member may have a lower compliance than the compliance of the suspension in order not to affect the suspension. Nevertheless, the compliant member may act to decouple a proportion of the mass of the suspension at higher frequencies from the voice coil assembly. Thus, the compliant member should improve the high frequency bandwidth without affecting a main resonance of the exciter system. The compliant section may also introduce a second resonance to the exciter which may adjust the overall frequency response of the exciter.

The exciter system may further comprise damping to control spurious resonances. The damping may be in the form of a resilient layer and/or a visco-elastic layer in contact with any one of the compliant section or the suspension, which may introduce resistive damping.

The invention claimed is:

1. Inertial exciter for an acoustic radiator, the exciter comprising:

a magnet assembly;

a coupler adapted for attachment to a surface of the acoustic radiator and adapted for relative movement with respect to the magnet assembly;

a voice coil assembly attached to the coupler; and a suspension attached to the coupler and the magnet assembly for supporting the magnet assembly adjacent the voice coil assembly relative to the coupler;

wherein the suspension lies substantially in a plane generally passing through the centre of mass of the magnet assembly, thereby reducing any moment acting on the suspension.

2. Inertial exciter according to claim 1, wherein the suspension is generally planar.

3. Inertial exciter according to claim 2, wherein the suspension is a spider formed from a corrugated foil of metal.

4. Inertial exciter according to claim 2, wherein the suspension is a spider formed of polymer.

5. Inertial exciter according to claim 2, wherein the suspension is a spider formed of strengthened cloth.

6. Inertial exciter according to claim 2, wherein the suspension is in the form of an arm type cantilever.

7. Inertial exciter according to claim 6, further comprising a compliant member connected in mechanical series connection between a region of the coupler local to the voice coil assembly and regions of the coupler to which the suspension is attached.

8. Inertial exciter according to claim 7, wherein the compliant member has a lower compliance than the compliance of the suspension.

9. Inertial exciter according to claim 8, further comprising damping to control spurious resonances.

10. Inertial exciter according to claim 2, wherein the suspension is co-moulded or moulded integrally with the coupler.

11. Inertial exciter according to claim 2, wherein the magnet assembly comprises a magnet sandwiched between a magnet cup and a pole piece, the cup defining a magnet gap which is filled with retentive fluid of suitable viscosity to damp motion of the voice coil.

12. Inertial exciter according to claim 2, wherein the suspension is attached to the coupler towards the periphery of the exciter to provide restoring forces to control residual unwanted asymmetric movement.

13. Inertial exciter according to claim 1, wherein the suspension is generally planar.

14. Inertial exciter according to claim 13, wherein the suspension is in the form of an arm type cantilever.

15. Inertial exciter according to claim 14, further comprising a compliant member connected in mechanical series connection between a region of the coupler local to the voice coil assembly and regions of the coupler to which the suspension is attached, the compliant member having a lower compliance than the compliance of the suspension.

16. Inertial exciter according to claim 1, wherein the suspension is attached to the coupler towards the periphery of the exciter to provide restoring forces to control residual unwanted asymmetric movement.

17. Inertial exciter assembly comprising an inertial exciter according to claim 1, a base plate for attachment to an acoustic radiator in a non-repeatedly engageable manner, and an exciter attached to said base plate in a repeatedly engageable manner.

18. Inertial exciter assembly according to claim 17, wherein said exciter is engageable with said base plate via a connection.

19. Inertial exciter assembly according to claim 18, wherein said connection is a threaded connection.

20. Inertial exciter assembly according to claim 18, and including a locking device for locking said connection.

21. Bending wave loudspeaker comprising an acoustic radiator and an inertial exciter according to claim 1, wherein said coupler is attached to the acoustic radiator.

22. Bending wave loudspeaker according to claim 21, wherein the suspension is generally planar.

23. Bending wave loudspeaker according to claim 21, wherein said coupler comprises a base plate, and said exciter is an inertial exciter.

24. Bending wave loudspeaker according to claim 23, wherein said exciter is engageable with said base plate via a releasable connection.

25. Bending wave loudspeaker according to claim 24, wherein said releasable connection is a threaded connection.

26. Bending wave loudspeaker according to claim 25, further comprising a locking device for locking said threaded connection.

27. A loudspeaker exciter assembly for a bending wave loudspeaker, comprising:

a base plate configured to be mounted on the surface of a bending wave acoustic radiator in a non-repeatedly engageable manner;

an exciter attached to said base plate in a repeatedly engageable manner, wherein said exciter is engageable with said base plate via a releasable threaded connection; and a locking device for locking said threaded connection.

28. Loudspeaker exciter assembly according to claim 27, wherein said exciter is an inertial exciter.

29. Loudspeaker exciter assembly according to claim 27, further comprising adhesive for attaching the base plate to an acoustic radiator in a non-repeatedly engageable manner.

30. Bending wave loudspeaker comprising:

a bending wave acoustic radiator;

a base plate configured to be mounted on the surface of the acoustic radiator in a non-repeatedly engageable manner;

an exciter attached to said base plate in a repeatedly engageable manner, wherein said exciter is engageable with said base plate via a releasable threaded connection; and a locking device for locking said threaded connection.

31. Bending wave loudspeaker according to claim 30, wherein the base plate is integral with the acoustic radiator.

32. Bending wave loudspeaker according to claim 30, wherein the base plate is adhesively bonded to the acoustic radiator.

33. Bending wave loudspeaker according to claim 30, wherein said exciter is an inertial exciter.

* * * * *